US011957953B2

(12) United States Patent
Rozo

(10) Patent No.: US 11,957,953 B2
(45) Date of Patent: Apr. 16, 2024

(54) RESISTANCE TYPE EXERCISE DEVICE FOR CONDITIONING

(71) Applicant: Maurice Rozo, Porter Ranch, CA (US)

(72) Inventor: Maurice Rozo, Porter Ranch, CA (US)

( * ) Notice: Subject to any disclaimer, the term of this patent is extended or adjusted under 35 U.S.C. 154(b) by 303 days.

(21) Appl. No.: 17/552,350

(22) Filed: Dec. 15, 2021

(65) Prior Publication Data

US 2023/0181966 A1 Jun. 15, 2023

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 23/04*** | (2006.01) |

(52) U.S. Cl.

CPC ..... *A63B 21/4045* (2015.10); *A63B 21/0428* (2013.01); *A63B 21/0552* (2013.01); *A63B 21/4034* (2015.10); *A63B 21/4035* (2015.10); *A63B 23/03541* (2013.01); *A63B 23/0417* (2013.01)

(58) Field of Classification Search

CPC . A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/4033; A63B 21/4034; A63B 21/4035; A63B 21/4045; A63B 22/20; A63B 22/201; A63B 22/203; A63B 23/035; A63B 23/03516; A63B 23/03533; A63B 23/03541; A63B 23/04; A63B 23/0405; A63B 23/0417; A63B 23/047; A63B 69/18; A63B 69/182; A63B 2208/0295; A63B 2225/09; A63B 2225/093

See application file for complete search history.

(56) References Cited

U.S. PATENT DOCUMENTS

| | | | | | |
|---|---|---|---|---|---|
| 1,982,843 | A * | 12/1934 | Traver | A63B 22/0076 | 482/70 |
| 3,589,720 | A * | 6/1971 | Agamian | A63B 22/203 | 482/114 |
| 4,496,147 | A * | 1/1985 | DeCloux | A63B 21/0083 | 482/53 |
| 4,512,571 | A * | 4/1985 | Hermelin | A63B 22/0007 | 482/70 |
| 4,979,731 | A * | 12/1990 | Hermelin | A63B 22/001 | 482/70 |
| 5,518,483 | A * | 5/1996 | Oswald | A63B 21/012 | 482/130 |
| 5,656,003 | A * | 8/1997 | Robinson | A63B 23/0417 | 482/93 |

(Continued)

*Primary Examiner* — Gary D Urbiel Goldner

(74) *Attorney, Agent, or Firm* — James A. Italia; Italia IP

(57) ABSTRACT

An exercise device accommodating leg thrust exercises is shown and described. The device provides a flat, nominally planar base or frame on which are mounted two slide members riding in parallel, linear tracks. Each slide is coupled to the frame by an elastic tether. A hand grip bar spans right and left sides of the frame at one end thereof. In use, a person grasps the hand grip bar, and places each foot on one of the slide members. The user then pushes with either one leg or alternatively, with both legs, against the resistance of the elastic tether.

15 Claims, 2 Drawing Sheets

(56) References Cited

U.S. PATENT DOCUMENTS

| | | | | |
|---|---|---|---|---|
| 7,438,673 | B1 * | 10/2008 | Jones | A63B 23/0355 482/907 |
| 8,500,611 | B2 * | 8/2013 | Hoffman | A63B 22/203 482/129 |
| 9,022,909 | B2 * | 5/2015 | Kermath | A63B 21/0428 482/133 |
| 10,617,927 | B2 * | 4/2020 | Osorio | A63B 22/203 |
| 2001/0036885 | A1 * | 11/2001 | Castellot, Jr. | A63B 21/4015 482/79 |
| 2005/0079956 | A1 * | 4/2005 | Bruno | A63B 69/0026 482/70 |
| 2013/0072361 | A1 * | 3/2013 | Ellis | A63B 22/0087 482/129 |
| 2014/0011645 | A1 * | 1/2014 | Johnson | A63B 23/03533 482/121 |
| 2014/0031175 | A1 * | 1/2014 | Peralo | A63B 21/4045 482/66 |
| 2020/0289884 | A1 * | 9/2020 | Davide | A63B 21/4035 |

* cited by examiner

RESISTANCE TYPE EXERCISE DEVICE FOR CONDITIONING

FIELD OF THE INVENTION

The present invention relates to exercise devices, and more particularly, to an exercise device having foot occupied and operated slide elements adapted to work against a resistance.

BACKGROUND OF THE INVENTION

Exercise devices have long been used to enable people to practice particular types of physical exercises. Such devices should be usable within a building, such as residence, to enable exercising to performed regardless of ambient weather conditions. To be practical, exercise devices should be of minimal weight, complexity, and bulk.

There exists a need for a practical exercise device enabling activation of numerous muscle systems to be developed and maintained.

SUMMARY OF THE INVENTION

The present invention provides a practical device for enabling leg thrust exercises. The device provides a flat, nominally planar base or frame on which are mounted two slide members riding in parallel, linear tracks. Each slide is coupled to the frame by an elastic tether. A hand grip bar spans right and left sides of the frame at one end thereof.

In use, a person grasps the hand grip bar and places each foot on one of the slide members. The user then pushes with one leg (or both if desired) against resistance of the elastic tether. Legs may be exercised alternatingly or simultaneously.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawing, in which like reference characters designate the same or similar parts throughout the several views, wherein

FIGS. 1-4 each show details of their respective subject matter drawn to scale, although the scale from Fig. to Fig. may vary.

DETAILED DESCRIPTION

Figure 1:
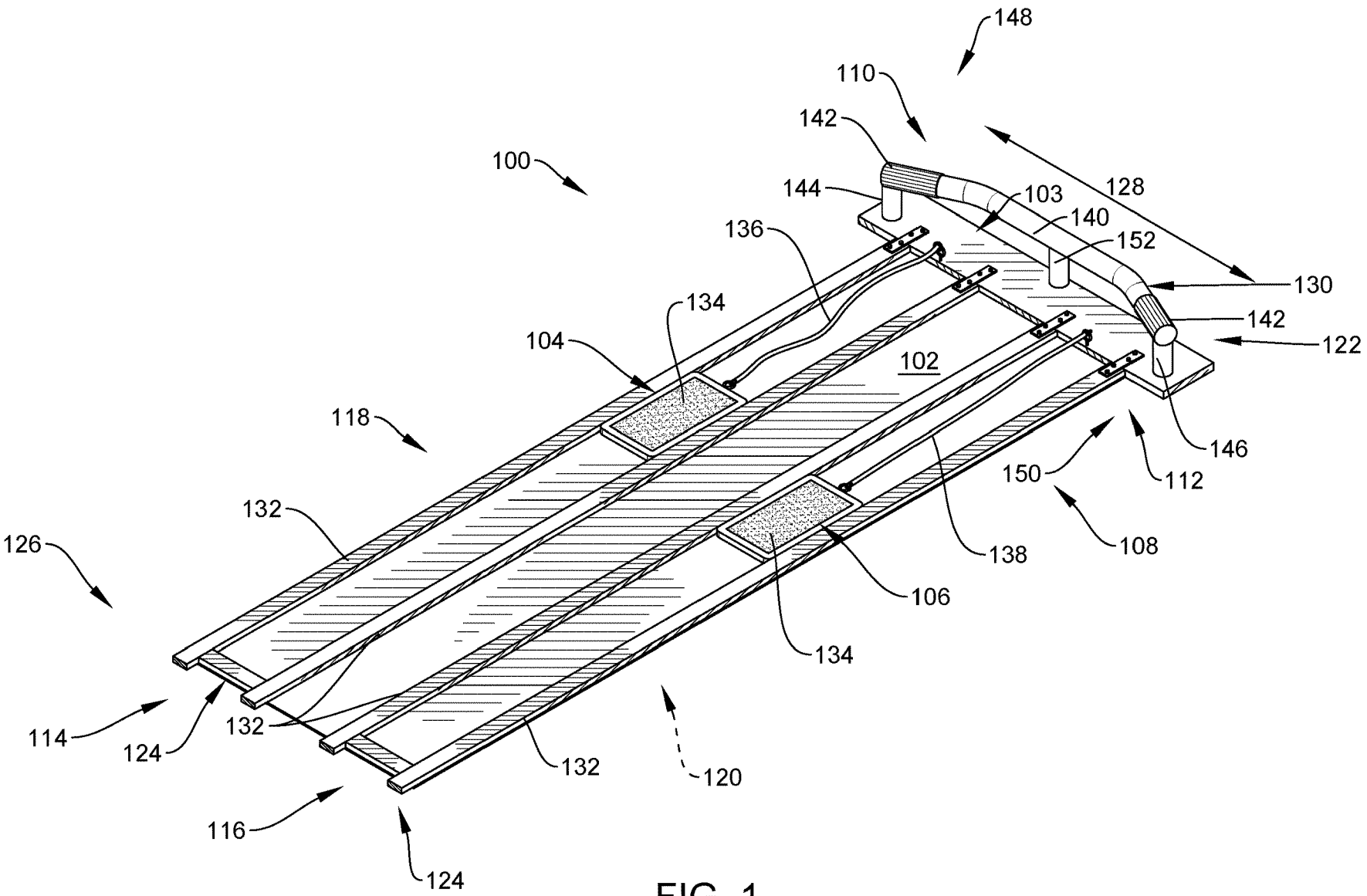
FIG. 1 is a top perspective view of an exercise device according to at least one aspect of the invention.

Referring first to FIG. 1, according to at least one aspect of the invention, there is shown an exercise device 100 comprising a frame 102, two slide members 104, 106 each constrained to slide along frame 102, a resistance element 108 yieldingly opposing sliding motion of each one of the two slide members 104, 106 along frame 102 independently of sliding motion of another slide member 104 or 106, and a hand grip 110 at one end 112 of frame 102 and coupled to frame 102. Hand grip 110 may be configured and dimensioned to enable a user (not shown) to grasp hand grip 110 with two hands while engaging each slide member 104 or 106 with one foot on each one of slide members 104, 106. Pushing with one leg and an associated foot on each slide member 104 or 106 urges that slide member 104 or 106 away from hand grip 110 against resistance of resistance element 108. Frame 102 may comprise a member having opposed flat, parallel faces 118, 120 along an entire length of frame 102, and tracks 114, 116 configured and dimensioned to laterally surround each one of slide members 104, 106. Tracks 114, 116 may each be coupled to frame 102 on one of the flat, parallel faces (e.g., face 118, as shown in FIG. 1) of frame 102.

Frame 102 may comprise a board or sheet of plywood, for example. Alternatively, rather than comprising a solid sheet, frame 102 may comprise an open skeleton (not shown) including boards and intervening voids.

In one embodiment of the invention, in exercise device 100, frame 102 may comprise member (e.g., a board) having opposed flat, parallel faces 118, 120 along an entire length of and coupled to frame 102, and tracks 114, 116 configured and dimensioned to laterally surround each one of slide members 104, 106, wherein tracks 104, 106 are each coupled to frame 102 on one of the flat, parallel faces 114, 116 of frame 102. Exercise device 100 may further comprise for each track 114 or 116, a first stop 122 limiting travel of one slide member 104 or 106 along track 114 or 116 at one end 112 of track, and a second stop 124 limiting travel of the other slide member 106 or 104 along track 116 or 114 at an opposed end 126 of track 114 or 116. Frame 102 may comprise a structural cross member 103 coupled to frame 102 and spanning a width (shown as arrow 128) of frame 102, and a bar 130 parallel to frame 102. Bar 130 may be spaced apart from frame 102 on the same flat, parallel face 118 of frame 102 as that along which slide members 104, 106 are constrained to slide.

In the illustrated embodiment, the length extends from end 112 of frame 102 to end 126 of frame 102.

Structural cross member 103 may comprise a wooden board, for example.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Slide members 104, 106 comprise slidably movable platforms for engaging feet of the user. Slide members 104, 106 may include a friction lining 134 to oppose a foot of the user from sliding out of contact with slide member 104 or 106 when exercising.

Resistance element 108 may comprise a flexible, elastic tether coupled proximate end 112 of frame 102 and coupled to hand grip 110. The tether may comprise a bungee cord. A bungee cord is an elastic cord composed of one or more elastic strands forming a core, usually but not necessarily covered in a woven cotton or polypropylene sheath. The sheath does not materially extend elastically, but it is braided with its strands spiralling around the core so that a longitudinal pull causes it to squeeze the core, transmitting the core's elastic compression to the longitudinal extension of the sheath and cord.

In the illustrated embodiment, resistance element 108 comprises a flexible, elastic tether further comprising a first section 136 coupled to one of slide members 104, 106 and to frame 102, and a separate second section 138 coupled to another one of slide members 104, 106 and to frame 102. In this embodiment, first section 136 and second section 138 of the flexible, elastic tether each comprises a bungee cord.

In the illustrated embodiment, tracks 114, 116 are defined by strips 132 of a structural material such as wood, metal, or a rugged plastic or composite material. Alternatively, tracks 114, 116 could be formed as wide grooves formed in frame 102.

Hand grip 110 may span at least beyond both tracks 114, 116 along width 128 of frame 102. In the illustrated embodiment, hand grip 110 overhangs a full extent of frame 102 along width 128 of frame 102. Bar 130 may be curved with a concave side 140 of the curve facing slide members 104, 106. Hand grip 110 may include a resilient cover 142 covering bar 130. It will be understood that resilient cover 130 may comprise a single part, or alternatively, and as shown in FIG. 1, may comprise more than one part, with at least one portion of bar 130 exposed to view.

Bar 130 may include a first stanchion 144 coupling bar 130 to frame 102 at one end 148 of bar 130, a second stanchion 146 coupling bar 130 to frame 102 at an opposed end 150 of bar 130, and a third stanchion 152 coupling bar 130 to frame 102 between first stanchion 144 and second stanchion 146.

Structural cross member 103 may be located and configured to serve as a stop limiting travel of each slide member 104 or 106 along associated tracks 114, 116 at one end 112 of frame 102. In this situation, separate stops (not shown, but corresponding to stops 124) may be provided if desired.

Figure 2:
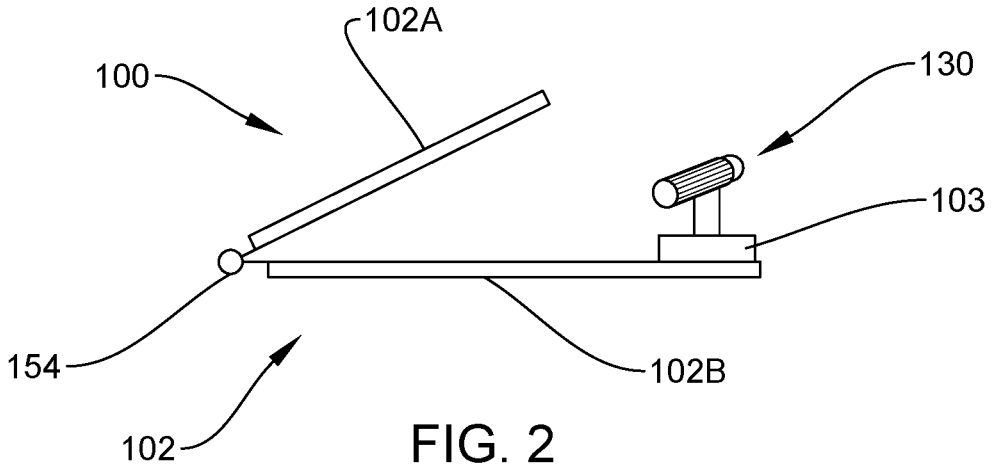
FIG. 2 is a side detail view of an alternative embodiment of FIG. 1, and is drawn to reduced scale.

Referring to FIG. 2, frame 102 may be formed in two mutually movable sections 102A, 102B united at a joint 154 enabling hinged pivoting of mutually moved sections 102A, 102B. Joint 154 may comprise a piano hinge for example.

Figure 3:
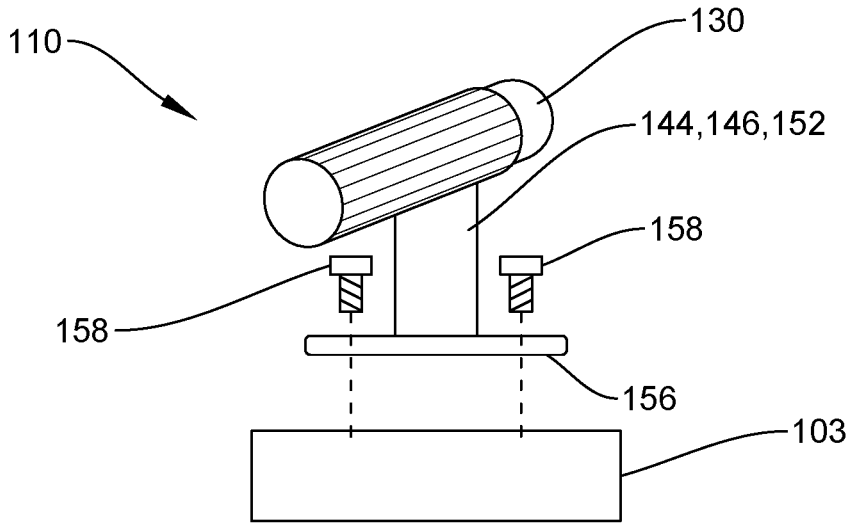
FIG. 3 is an enlarged detail view of a further alternative embodiment of FIG. 1, and depicts elements seen at the right of FIG. 1.

Referring to FIG. 3, hand grip 110 may comprise a fastening enabling handgrip 110 to be removably coupled to frame 102. In this embodiment, handgrip 110 may comprise flanges 156 fixed to stanchions 144, 146, 152 (see also FIG. 1). Each flange 156 may have a hole (not seen in the view of FIG. 3) enabling a fastener such as bolt 158 to be passed therethrough. Bolt 158 may engage compatible threading (not visible in FIG. 3) in structural cross member 103 or elsewhere in frame 102. Toolless fastenings, such as screws having enlarged wingnut heads (not shown), may be employed as an alternative to bolts 58 or other fasteners requiring tools for installation and removal.

Figure 4:
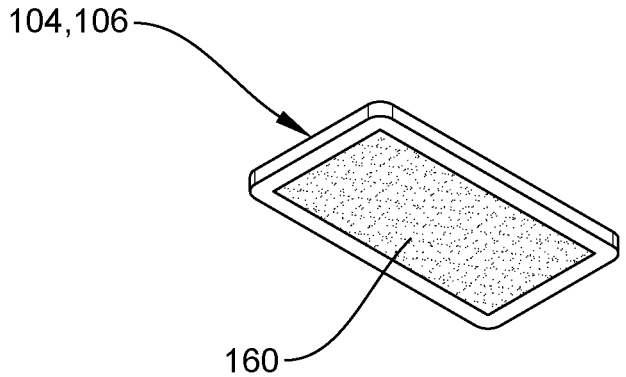
FIG. 4 is a bottom perspective detail view of an alternative embodiment of elements shown at the center of FIG. 1.

In an embodiment shown in FIG. 4, slide members 104, 106 may further comprise a friction element 160, for varying sliding friction thereof along tracks 114, 116. Friction element 160 may comprise a rubber or other material which frictionally engages tracks 114, 116, or may take other forms.

Exercise device 100 may be made from wood, robust plastics, light metal alloys, and combinations of these.

Resistance element 108 may utilize springs, internally expansible pneumatic or hydraulic resistance devices, or other forms of resistance, if desired.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. An exercise device comprising a frame, two slide members each constrained to slide along the frame, a resistance element yieldingly opposing sliding motion of each one of the two slide members along the frame independently of sliding motion of the other said slide member, and a hand grip at one end of the frame and coupled to the frame, the hand grip configured and dimensioned to enable a user to grasp the hand grip with two hands while engaging each said slide member with one foot on each one of the slide members, whereby pushing with one leg and an associated foot on each said slide member urges that slide member away from the hand grip against resistance of the resistance element;

wherein:

the frame comprises a member having opposed flat, parallel faces along an entire length of the frame, and two tracks configured and dimensioned to respectively and laterally surround each one of the slide members, wherein each of the two tracks is respectively coupled to the frame on one of the flat, parallel faces of the member of the frame;

the exercise device further comprising for each track, a first stop limiting travel of one said slide member along the track at one end of the track, and a second stop limiting travel of the other said slide member along the other track at an opposed end of the track; and the frame further comprises a structural cross member coupled to the frame and spanning a width of the frame, and the hand grip comprises a bar parallel to the frame, spaced apart from the frame on the opposed flat, parallel faces of the frame along which the slide members are constrained to slide, and coupled to the structural cross member.

2. The exercise device of claim 1, wherein the hand grip spans at least beyond both said tracks, along a width of the frame.

3. The exercise device of claim 1, wherein the hand grip overhangs a full extent of the frame along a width of the frame.

4. The exercise device of claim 1, wherein the bar is curved, with a concave side of the curve facing the slide members.

5. The exercise device of claim 1, wherein the hand grip includes a resilient cover covering the bar.

6. The exercise device of claim 5, wherein the bar includes a first stanchion coupling the bar to the frame at one end of the bar, a second stanchion coupling the bar to the frame at an opposed end of the bar, and a third stanchion coupling the bar to the frame between the first stanchion and the second stanchion.

7. The exercise device of claim 1, wherein the resistance element comprises a flexible, elastic tether coupled proximate to an end of the frame coupled to the hand grip.

8. The exercise device of claim 7, wherein the flexible, elastic tether comprises a bungee cord.

9. The exercise device of claim 7, wherein the flexible, elastic tether comprises a first section coupled to one of the slide members and to the frame, and a separate second section coupled to the other one of the slide members and to the frame.

10. The exercise device of claim 9, wherein the first section and the second section of the flexible, elastic tether each comprise a bungee cord.

11. The exercise device of claim 1, wherein each one of the slide members includes a friction lining to oppose a foot of the user from sliding out of contact with the slide member when exercising.

12. The exercise device of claim 1, wherein the structural cross member also is located and configured to serve as a stop limiting travel of each said slide member along associated said tracks at one end of the frame.

13. The exercise device of claim 1, wherein the frame is formed in two mutually movable sections united at a joint enabling hinged pivoting of the two mutually movable sections.

14. The exercise device of claim 1, wherein the hand grip comprises a fastening enabling the handgrip to be removably coupled to the frame.

15. The exercise device of claim 1, wherein the slide members further comprise a friction element, for varying sliding friction thereof along the tracks.

* * * * *